US005243329A

United States Patent [19]

Happer, Jr.

[11] Patent Number: 5,243,329

[45] Date of Patent: Sep. 7, 1993

[54] SMOKE ALARM FOR USE WITH AN ELECTRONIC TIMING DEVICE

[76] Inventor: Robert L. Happer, Jr., 721 Gallbush Rd., Chesapeake, Va. 23322

[21] Appl. No.: 760,012

[22] Filed: Sep. 13, 1991

[51] Int. Cl.[5] ..... G08B 17/10

[52] U.S. Cl. ..... 340/628; 340/693; 368/11

[58] Field of Search ..... 340/628, 629, 630, 632, 340/693; 368/10, 12, 11

[56] References Cited

U.S. PATENT DOCUMENTS 1,240,618 9/1917 Stevens ..... 368/12
2,552,331 5/1951 Lamb ..... 368/12
4,186,389 1/1980 Flittie ..... 340/630
4,611,200 9/1986 Stilwell ..... 340/628
4,796,015 1/1989 Admire, Jr. ..... 340/628
4,949,077 8/1990 Mbuthia ..... 340/628

*Primary Examiner*—Jeffrey Hofsass
*Attorney, Agent, or Firm*—Richard C. Litman

[57] ABSTRACT

A device for sensing smoke and providing an indication upon the sensing of smoke is disclosed. A housing, being in the shape of a wrist watch, includes an electronic circuit that senses smoke and provides an indication to those in the vicinity of the device. This indication allows those in this vicinity to easily locate the device. The housing further includes the features of providing the time of day to a user.

8 Claims, 1 Drawing Sheet

SMOKE ALARM FOR USE WITH AN ELECTRONIC TIMING DEVICE

FIELD OF THE INVENTION

The present invention discloses a smoke alarm for use with electronic timing devices. A housing, being in the shape of a wrist watch, includes an electronic circuit that senses smoke and provides an indication to those in the vicinity of the device. The housing further includes the features of a time piece.

DESCRIPTION OF THE RELATED ART

Attempts have been made to make smoke detector alarms. Such attempts are shown in U.S. Pat. Nos. 3,747,331; 4,611,200; 4,904,988 issued to Nyberg, Stilwell and Nesbit et al., respectively. More specificly, the patent issued to Stilwell discloses a portable battery powered smoke detector and clock. The smoke detector is attached to a structure such that it is placed high in a room. The patent issued to Nesbit et al. discloses a toy with a built-in smoke detector. The patent issued to Nyberg discloses an alarm clock with a temperature alarm.

Other attempts have been made to combine electronic timing devices with other electrical features. Such attempts are shown in U.S. Pat. Nos. 4,151,831; 4,257,112; and 4,521,120 issued to Lester, Hubner and Blank et al., respectively. None of the above disclosures discloses nor suggest the particulars of applicant's invention of using a smoke alarm with an electronic timing device.

SUMMARY OF THE INVENTION

The present invention relates to a smoke detecting alarm which is combined with an electronic timing device. The present invention emits a sound which can be heard by personnel in the vicinity of the smoke alarm.

Accordingly, an object of the present invention is to provide a smoke detecting device with the ability to alert others in the vicinity of the device.

Another object of the present invention is to provide a smoke detecting device with an electronic timing device.

Still another object of the present invention is to provide a smoke detecting device with alarm means.

A further object of the present invention is to provide a smoke detecting device with display means for displaying the time of day.

These and other objects regarding the features on the present invention will become apparent to those skilled in the art, such as having a smoke detecting device with different forms of attachment means to keep the smoke detecting device attached to an user.

DESCRIPTION OF THE PREFERRED EMBODIMENTS

Figure 1:
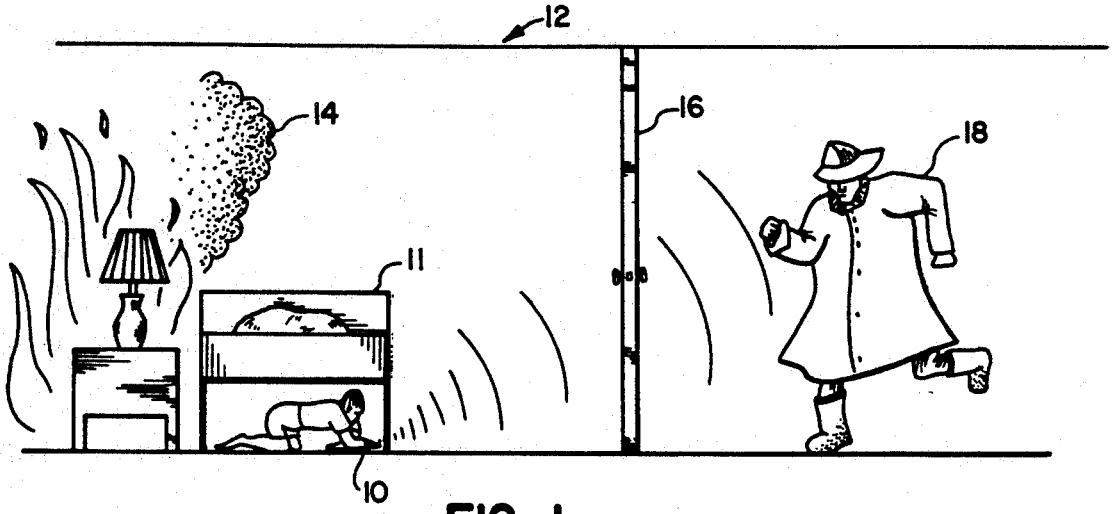
FIG. 1 shows a smoke alarm and electronic timing device being used in a typical environment.

Referring to FIG. 1, shown is a smoke alarm and electronic timing device 10 being worn by a person. In most homes, children are taught to stay low when fire and smoke 14 are present. Often children seek shelter under a bed 11 when a fire occurs. The smoke alarm and electronic timing device 10 senses the smoke and emits a loud sound which can be heard by the parents or firefighters 18. When a firefighter 18 hears the sound being emitted from the device 10, even through a door 16, the location of the child or handicap can be readily located. The present device 10 can be worn by children or the handicap at all times.

Figure 2A:
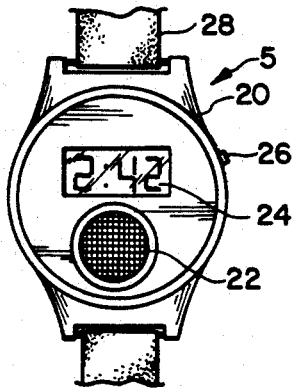
FIGS. 2A and 2B show a smoke alarm being used with an electronic timing device.
Figure 2B:
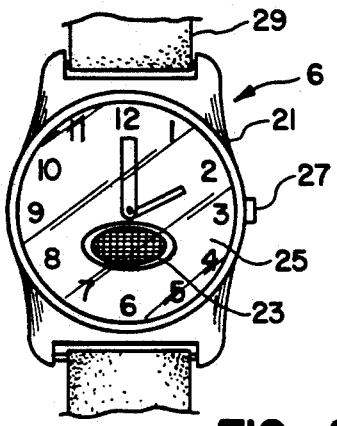

Referring to FIGS. 2A and 2B, shown are two smoke alarm and electronic timing devices 5,6 according to the preferred embodiments. In FIG. 2A, the device 5 includes a water tight housing 20 which has included therein a digital display 24, a speaker 22, and an adjustment tab 26. The device 5 further includes a strap 28 for attaching the device 5 to the arm of a person, i.e. the child or the handicap. In FIG. 2B, the device 6 includes a water tight housing 21 which has included therein an analog display 25, a speaker 22, and an adjustment tab 26. The device 6 further includes a strap 29 for attaching the device 6 to the arm of a person, i.e. the child or the handicap. As shown in FIGS. 2A and 2B, the devices 5,6 function as time pieces and as smoke alarms. The operation of the devices will be explained with reference to FIG. 3.

Figure 3:
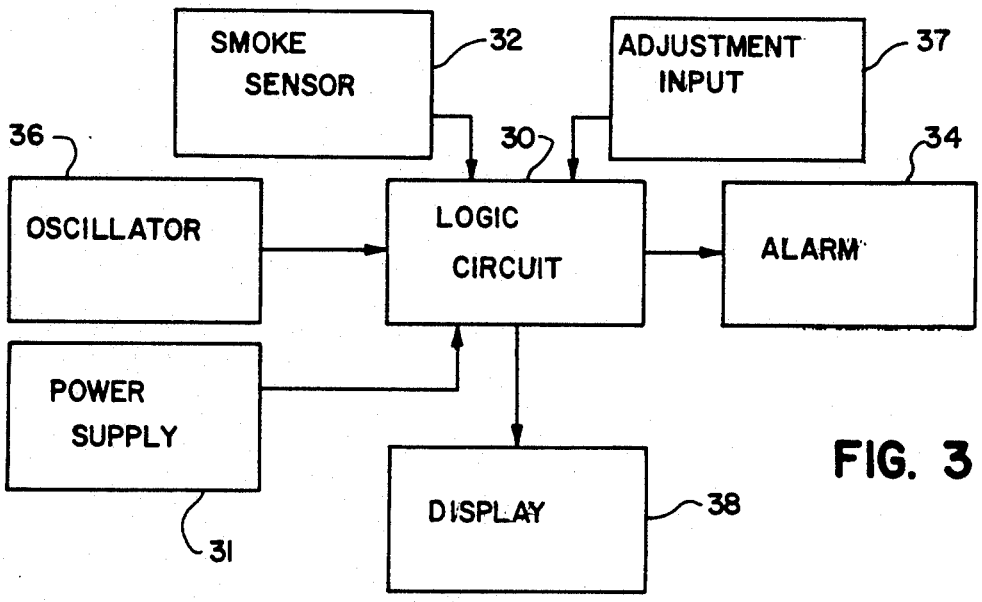
FIG. 3 shows a schematic of the smoke alarm being used with an electronic timing device.

Referring to FIG. 3, shown is a schematic diagram for the smoke alarm for use with an electronic timing device. The sensor 32 checks for a predetermined level of smoke in the air. Once this level is reached, it sends a trigger signal to a logic circuit 30. The logic circuit 30, which may consist of a programmable processor, shift registers, counters or the like, receives the signal from the smoke sensor 32 and causes an alarm 34 to sound.

The logic circuit 30 also receives two additional signals. One such additional signal is generated by an oscillator circuit 36. The oscillator circuit 36 serves as a constant clock source to drive the logic circuit 30. The logic circuit 30, under the control of the constant clock source, controls a display circuit 38. The display circuit 38 can take the form of a digital display, like that shown in FIG. 2A. In an alternative embodiment, the display circuit may take the form an analog display, like that shown in FIG. 2B. In either embodiment, the display circuit 38 contains the necessary components to give the time of day. For example, the digital display may contain drivers which are used to drive either LCD'S or LED'S. The analog display may contain a quartz motor to move the hands of the display. The motor would be controlled by the logic circuit 30. Another additional signal is generated by an adjustment input circuit 37. The logic circuit 30, under the control of the adjustment input circuit 37, changes the time of day of the display circuit by controlling the frequency of the signal to the display circuit 38. In one mode, the frequency would be, for example, 100 times the normal frequency of the signal from the logic circuit 30. In a second mode, the frequency would be 10 times the normal frequency. The second mode is used for fine adjustments to the time of day.

Further disclosed in FIG. 3 is a power supply 31. The power supply is used for supplying power to the necessary components through the logic circuit 30. The power supply 31 may be any standard type of battery used with electronic wrist watches.

Although the instant invention has been described with respect to specific details of certain preferred embodiments thereof, it is not intended that such details limit the scope of the instant invention, except as is set forth in the following claims.

I claim:

1. A device for sensing smoke and providing an indication upon the sensing of smoke comprising:

a wristwatch including display means for displaying the time of day;

attachment means for attaching said wristwatch to the wrist of a person;

said wristwatch including electronic circuit means for providing said indication;

whereby said electronic means, upon sensing smoke, providing said indication to said person and other personnel in the vicinity of the device.

2. A device as claimed in claim 1 wherein said electronic circuit means also outputs signals indicating the time of day.

3. A device as claimed in claim 1 wherein said electronic circuit means also outputs signals, corresponding to the time of day, to said display means.

4. A device as claimed in claim 2 wherein said wristwatch further includes adjustment means for adjusting said electronic circuit means.

5. A device as claimed in claim 4 wherein said adjustment means adjust the indicated time of day.

6. A device as claimed in claim 1 wherein said electronic circuit means includes logic circuit means for controlling said display means.

7. A device as claimed in claim 6 wherein said electronic circuit means includes sensor means for sensing the presence of smoke, said sensor means provides a signal to said logic circuit means upon said presence of smoke.

8. A device as claimed in claim 7 wherein said logic circuit means provides an alert signal to an alarm upon receipt of said signal from said sensor means.

* * * * *